US005694896A

United States Patent [19]

Melvin

[11] Patent Number: 5,694,896

[45] Date of Patent: Dec. 9, 1997

[54] ENGINE PRE-OILER

[76] Inventor: Kerry L. Melvin, 15493 Highway 144, Fort Morgan, Colo. 80701

[21] Appl. No.: 701,106

[22] Filed: Aug. 21, 1996

[51] Int. Cl.[6] ..... F01M 5/02

[52] U.S. Cl. ..... 123/196 S; 184/6.3

[58] Field of Search ..... 123/196 S; 184/6.3

[56] References Cited

U.S. PATENT DOCUMENTS

| | | | |
|---|---|---|---|
| 2,747,564 | 5/1956 | Wehling | 123/196 S |
| 2,755,787 | 7/1956 | Butler et al. . | |
| 3,853,525 | 12/1974 | Holcomb | 123/196 S |
| 4,061,204 | 12/1977 | Kautz, Jr. . | |
| 4,094,293 | 6/1978 | Evans | 123/196 S |
| 4,199,950 | 4/1980 | Hakanson et al. . | |
| 4,513,704 | 4/1985 | Evans . | |
| 4,825,826 | 5/1989 | Andres . | |
| 4,940,114 | 7/1990 | Albrecht | 123/196 S |
| 5,069,177 | 12/1991 | Dokonal | 123/196 S |
| 5,147,014 | 9/1992 | Pederson . | |
| 5,156,120 | 10/1992 | Kent . | |
| 5,197,424 | 3/1993 | Blum . | |
| 5,244,059 | 9/1993 | McLaughlin . | |
| 5,348,121 | 9/1994 | McLaughlin . | |
| 5,474,042 | 12/1995 | Kaneda . | |
| 5,488,935 | 2/1996 | Berry, Jr. . | |
| 5,494,012 | 2/1996 | Hagen | 123/196 S |

*Primary Examiner*—Erick R. Solis
*Attorney, Agent, or Firm*—Rick Martin

[57] ABSTRACT

A simple pre-oiler has a hollow pressure vessel and a control valve tapped into the engine oil system. The control valve has only one moving part, a plug which is balanced by the engine oil pressure and the vessel pressure. When the engine oil pressure exceeds the vessel pressure, the control valve opens to fill the vessel. When start-up occurs, a solenoid opens the control valve to discharge the vessel's pressurized oil into the engine oiling system. A filler plug allows a metered amount of oil to be added to the vessel. Air pressure can then be added to the vessel. By timing the period to empty the vessel's oil into a non-running engine, an engine-wear test is accomplished.

19 Claims, 5 Drawing Sheets

ENGINE PRE-OILER

FIELD OF INVENTION

The present invention relates to a pre-start lubricating system for reducing wear in an internal combustion engine at start-up by injecting oil under pressure from a vessel.

BACKGROUND OF THE INVENTION

Factory fresh engines installed in vehicles have an oiling system which is operational only after the engine has been started. Consequently, during start-up of an engine which permits its lubricating oil to drain down and be collected in an oil pan, there will be a period of time during which the internal components of the engine will be moving before they are lubricated again. The Society of Automotive Engineers have performed tests which indicate that 90 percent of the wear in an engine occurs during start-up, i.e., before the internal components are lubricated by the oiling system built into the engine.

Below follows a brief summary of known prior art attempts to pre-lubricate an engine at start-up.

U.S. Pat. No. 2,755,787 (1954) to Butler et al. discloses a cold start engine lubricating system having an oil container tapped into the oil feed line to the engine. At start-up, the spring diaphragm of the oil container injects oil into the engine. No heater for the injected oil is taught.

U.S. Pat. No. 4,061,204 (1977) to Kautz, Jr. discloses a cold start pre-oiler system having an oil container. A multi-purpose valve controls the injection of the oil into the cold engine.

U.S. Pat. No. 4,199,950 (1980) to Hakanson et al. discloses a cold start pre-oiler system having a high pressure atomizer.

U.S. Pat. No. 4,513,704 (1985) to Evans discloses a compact cold engine oil injection system.

U.S. Pat. No. 4,825,826 (1989) to Andres discloses a cold start oil injection system having a spring-loaded oil container.

U.S. Pat. No. 5,147,014 (1992) to Pederson discloses a cold start oil injection system.

U.S. Pat. No. 5,156,120 (1992) to Kent discloses a cold start oil injection system.

U.S. Pat. No. 5,244,059 (1993) to McLaughlin discloses a pre-oiler using both air and oil pressure to inject the oil.

U.S. Pat. No. 5,348,121 (1994) to McLaughlin discloses an air and oil pressure activated pre-oiler.

U.S. Pat. No. 5,474,042 (1995) to Kaneda discloses an air and oil pressure activated pre-oiler.

U.S. Pat. No. 5,488,935 (1996) to Berry, Jr. discloses an electromagnetic valve controlled pre-oiler.

Each of the above noted patents deals with the problem of dry start-up of an engine either in an ineffective manner or by way of complex and costly apparatus. Accordingly, there has continued to be a need for a lubricating system for the lubrication of an engine prior to start-up which is effective, simple, inexpensive to manufacture and which is easy to install on an existing engine without major modifications of the engine assembly.

The simplicity of the present invention lies in using a pressure vessel having a valve that contains only one moving part, a plug. The engine's oil pressure is used to pressurize the vessel. A solenoid releases the valve's plug at start-up. Alternatively, a vessel filler plug is used to pour oil into the vessel and pressurize it with air. Then the vessel can be used to protect the engine during an oil change and/or used to calibrate engine wear.

SUMMARY OF THE INVENTION

The main object of the present invention is to provide a very simple pre-oiler having minimal moving parts and minimal cost to manufacture.

Another object of the present invention is to provide a filler plug and air pressure inlet to the pressure vessel to enable operation during an oil change.

Another object of the present invention is to provide a means to calibrate the wear of the main bearings of an engine by providing a measurement of the time it takes to empty the contents of the vessel into the engine.

Another object of the present invention is to provide a system which is recharged by the engine's previous run cycle.

Other objects of this invention will appear from the following description and appended claims, reference being made to the accompanying drawings forming a part of this specification wherein like reference characters designate corresponding parts in the several views.

A hollow pressure vessel is mounted near the engine. A one-way moving part valve is mounted to an oil line at the base of the vessel. A solenoid triggered by the ignition switch is used to open the valve at start-up. When the engine is running, the valve permits the hollow vessel to fill up from the engine oil pressure.

Alternatively during an oil change, oil is poured into the vessel from a filler plug. An air pressure source charges the vessel. Now after an oil change, the first start is still pre-oiled.

The air pressure source can be combined with a simple stop watch to determine the wear of the main bearings of an engine. A measured amount of oil is put into the vessel. Then the vessel is pressurized to a set pressure such as 40 pounds. Then the vessel valve is opened. The time it takes to empty the vessel into the engine can be seen by looking at a transparent oil line segment. This time is logged during each oil change of an engine to determine the deterioration of the engine's main bearings and other critical seals. Large truck engines can be saved by early detection of weak seals.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
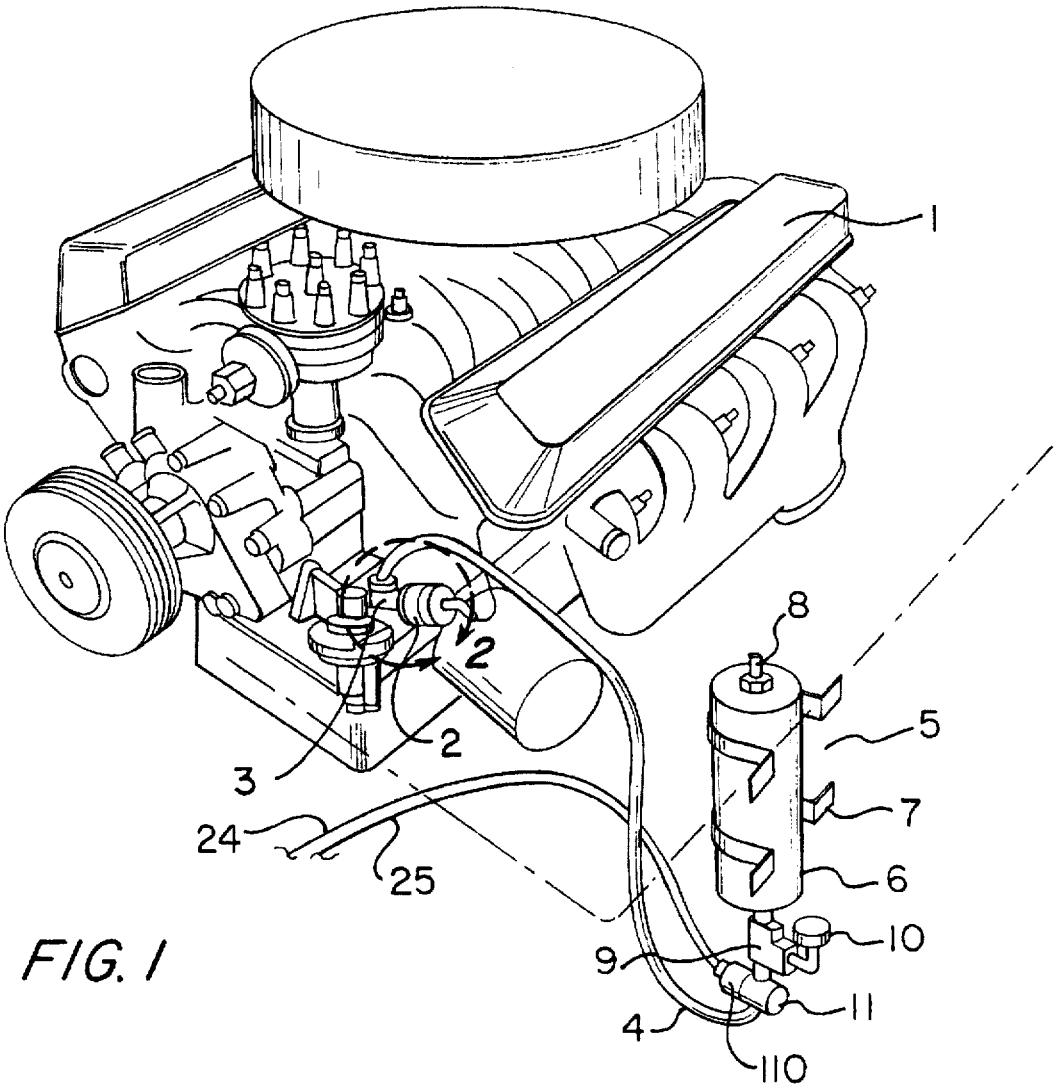
FIG. 1 is a top perspective view of the preferred embodiment mounted to a fire wall of an engine compartment.
Figure 2:
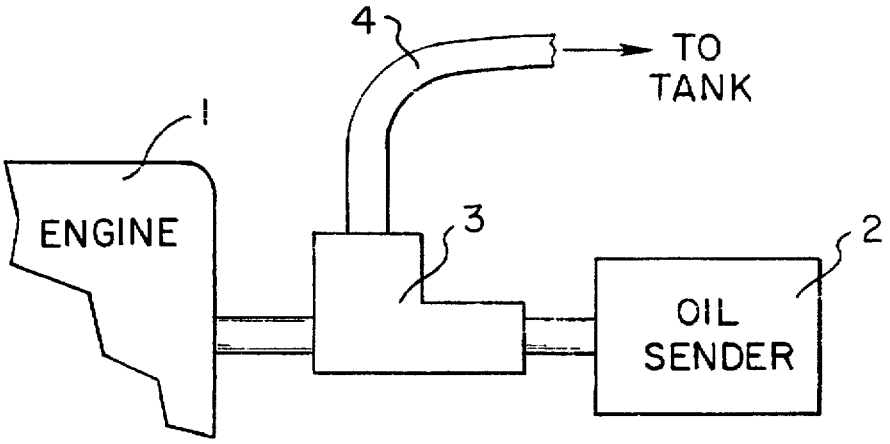
FIG. 2 is a schematic showing the typical way to connect the pre-oiler oil line to the engine.

Referring first to FIGS. 1, 2 an internal combustion engine 1 has a pressurized oil system for internal lubrication. Circled area 2 indicates a tap into the oil system having a T-connector 3 tap from the engine 1 to the oil line 4 which connects to the pre-oiler 5. A traditional oil sender 2 shares the T-connector 3.

The pre-oiler 5 has a vessel 6 held to the engine compartment by brackets 7. A filler plug 8 is on top of the vessel 6. A T-connector 9 taps into the bottom of vessel 6. A pressure gauge 10 allows the user to see the pressure in vessel 6. The control valve 11, known in the art as a globe valve, allows operating engine oil pressure to fill the vessel 6 until the pressure in vessel 6 equals the engine oil pressure. Then the control valve 11 automatically closes with spring pressure. At engine start-up, the solenoid 110 is opened by the ignition switch via wires 24, 25, thereby permitting the pressurized oil in vessel 6 to enter the oil system of engine 1 and lubricate the engine before start-up. The user can turn his ignition key on to open the solenoid 110. He can then watch his pressure gauge increase on his dashboard indicator. When the pressure reaches maximum, then he can start the engine.

Figure 3:
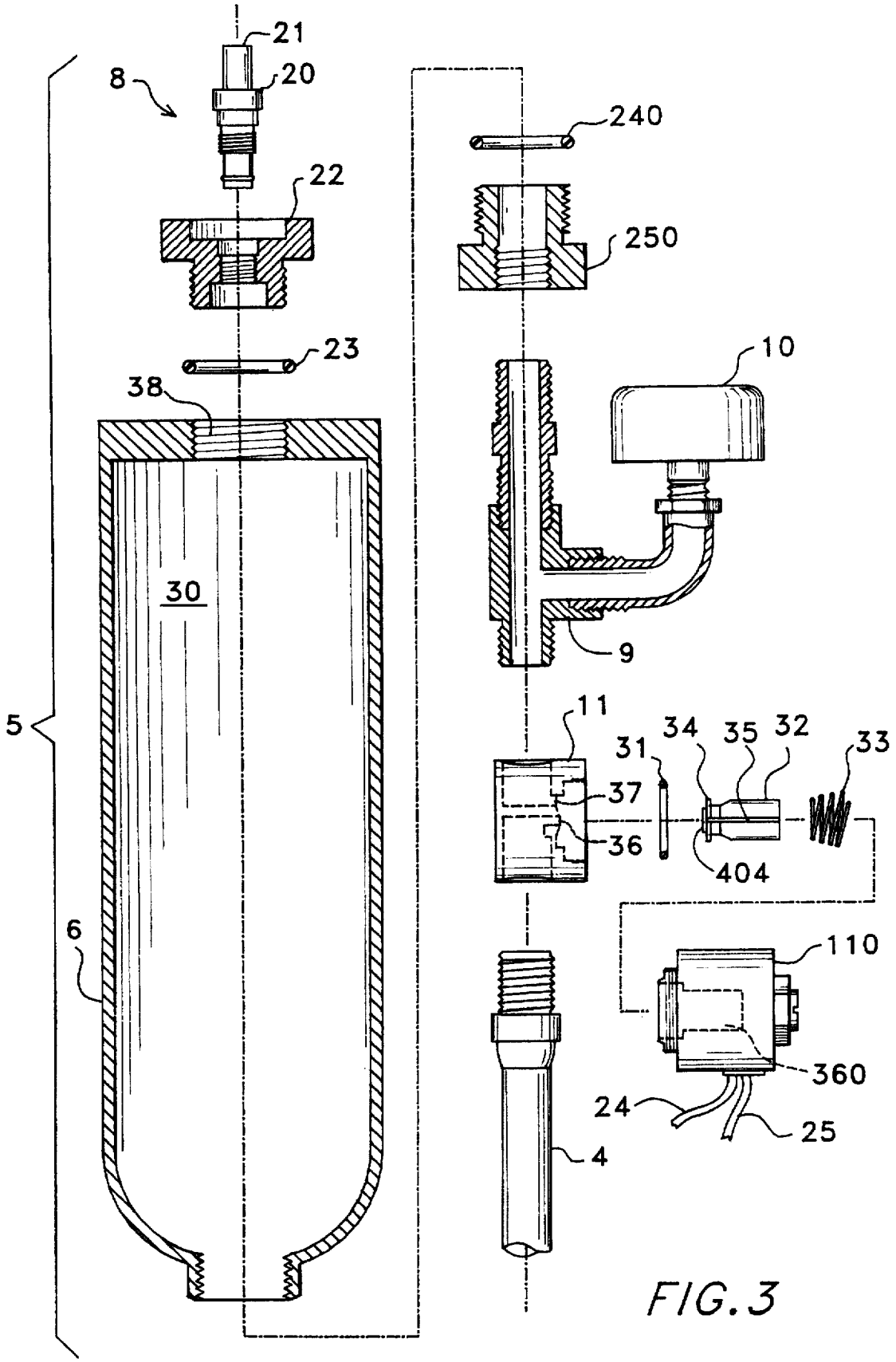
FIG. 3 is an exploded view of the pre-oiler shown in FIG. 1.

Referring next to FIG. 3 the vessel 6 can be made of aluminum, steel, or composite material. Although threaded inlets 38, 39 to the vessel are shown, precast mounting arrangements could also be used. Vessel 6 should be mounted within 45° of vertical.

When an engine remains off for 36 to 48 hours, most of the lubricating oil has run out of the bearing surfaces. The vessel 6 can hold its pressure from 9 months to two years. The filler plug 8 comprises a Schrader valve 20 having air inlet 21. This allows pressurizing the vessel 6 at any time before engine start-up. Plug 22 is sealed by washer 23 as it threads into inlet 38.

Adapter 250 seals the inlet 39 with washer 240. Pressure gauge 10 is mounted in T-connector 9. Alternatively, the T-connector 9 and the pressure gauge 10 could be mounted in the plug 22.

The control valve 11 has only one moving part, the plunger 32. Oil flows under pressure out the central part 36, into the chamber 360 (a pressure balancing chamber), and into the perimeter port(s) 37. The solenoid 110 having washer 31 screws into the control valve 11, thereby compressing spring 33 against washer 34 of plunger 32. Preferably the solenoid is a constant duty twelve-volt. It can be activated for long periods of time without experiencing a failure or degradation of performance. The valve and solenoid assembly is engineered for 20–30 million cycles. An oil filter or screen assembly could be added at either end of the valve 11. Oil line 4 is preferably made of a flexible hydraulic hose.

Figure 4:
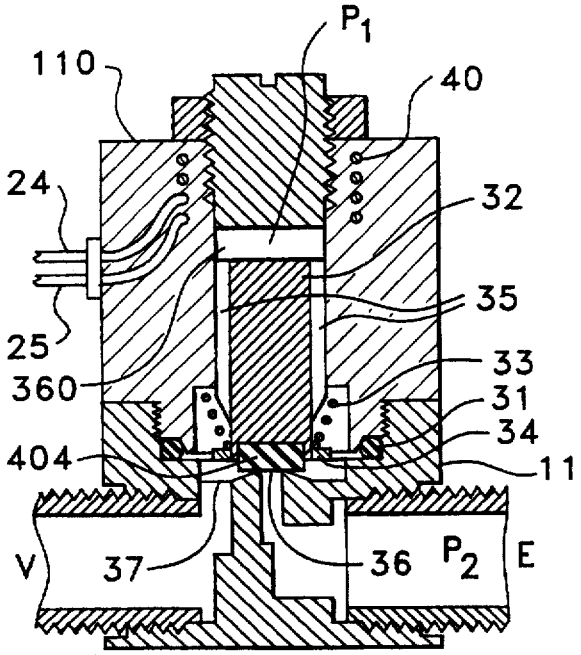
FIG. 4 is a sectional view of the control valve in the shut position.

Referring next to FIG. 4 the plug 32 is shown in the normally closed position powered by spring 33 pushing down washer 34. Solenoid 110 has coils 40 which when powered lift plug 32 up to the open position. In the open position (FIGS. 5, 6) oil can flow from the vessel noted as V up through perimeter port(s) 37 into chamber 360 via grooves 35 and out the central port 36 to the engine noted as E (or vice versa). Note that plug 32 has a pliable seat 404 for sealing purposes. Sometimes the vessel pressure is called the "above seat" pressure which functions to keep the seat 404 closed. "Below seat" pressure connotes engine pressure. In FIG. 4, pressure $p_1=p_2$ thereby enabling the spring 33 to hold the plug in the closed position. Plug 32 is made of solid metal. The seal 404 is made of sealing material such as rubber.

When the engine is off after an engine cycle, pressure $p_1$=40 psi (approximately) which would be the operating engine oil pressure, and $p_2$=0. When the engine is running and the vessel 6 is being filled with oil from the engine oil pressure, $p_2>p_1$. until the vessel is filled, then $p_2=p_1$. When $p_2=p_1$, the spring 33 closes the plug 32, thereby maintaining the pressure $p_1$ in the vessel 6.

Figure 5:
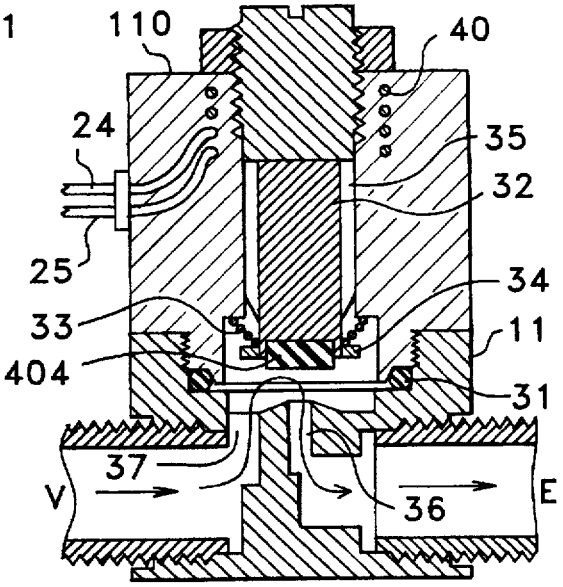
FIG. 5 is the control valve of FIG. 4 in the engine running, valve open position, where oil is entering the vessel.

FIG. 5 shows the solenoid 110 at engine start-up time. The ignition switch has opened plug 32 thereby enabling the oil under pressure $p_1$ to flow to the engine E which has zero oil pressure. This process continues until either the vessel 6 is empty or the user starts the engine.

Figure 6:
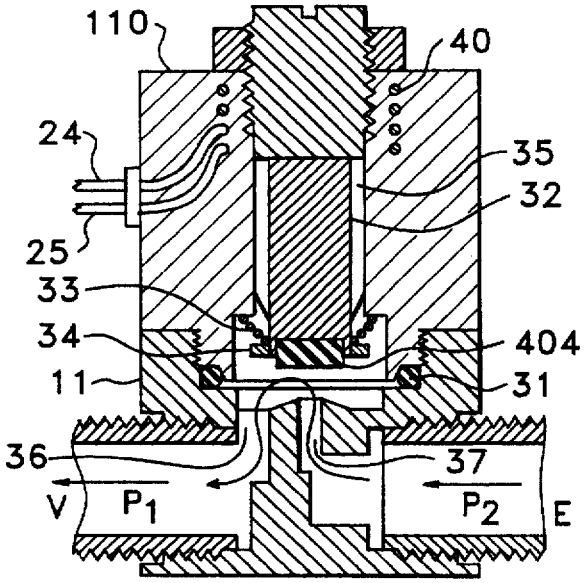
FIG. 6 is the control valve of FIG. 4, valve open by the ignition switch/solenoid to permit oil to discharge from the vessel.

FIG. 6 shows the solenoid 110 just after the engine is started. The vessel is low on oil. The plug 32 is held open by the pressure differential $p_2>p_1$. When the vessel fills, $p_2=p_1$, and the spring 33 can push the plug 32 to the closed position. Normally the solenoid would not remain powered during engine operation. However, boats or race cars could experience a momentary oil pressure drop during bumps or extreme acceleration/deceleration. By maintaining power to the solenoid during engine operation, the invention acts as an oil pressure accumulator which operates to supplement the engine oil pressure in these brief periods when $p_2$ drops below the pressure in the vessel.

Figure 7:
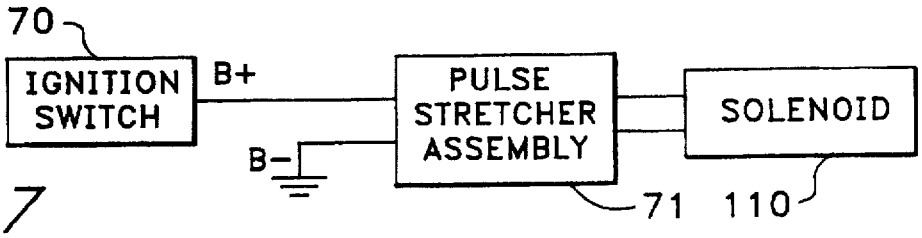
FIG. 7 is a schematic of the valve control circuit.

Referring next to FIG. 7 the ignition switch 70 is turned on by the user and preferably the user waits to see the engine pressure indicator show engine oil pressure from the vessel 6. Then the user starts the engine. Alternatively, the user can just rotate the ignition switch past the "on" position to the start position, and the pulse stretcher assembly 71 will automatically power solenoid 110 for a preset time duration.

Figure 8:
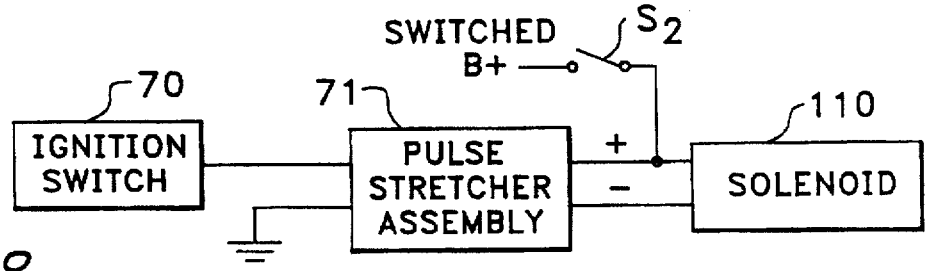
FIG. 8 is a schematic of a manual control switch used to open the valve.
Figure 11:
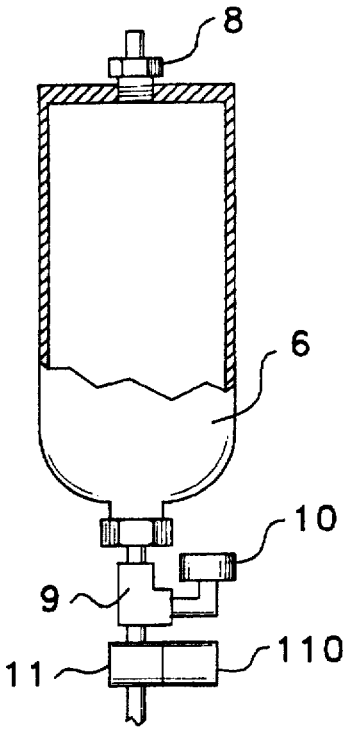
FIG. 11 is a side plan view of the vessel with a cutaway.
Figure 12:
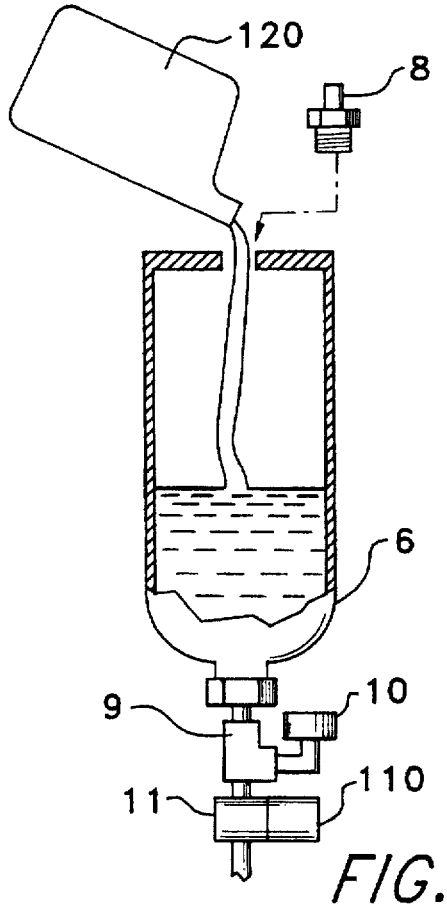
FIG. 12 is the view of FIG. 11 showing the vessel being manually filled.
Figure 13:
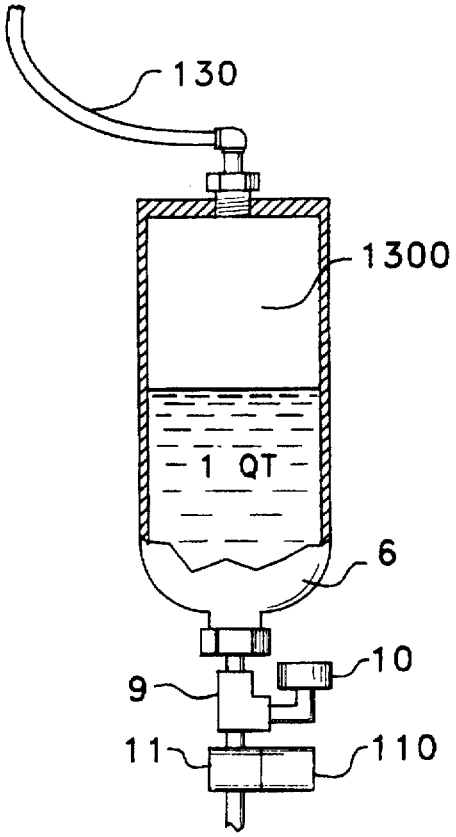
FIG. 13 is the view of FIG. 11 showing the vessel filled with one quart of oil.
Figure 14:
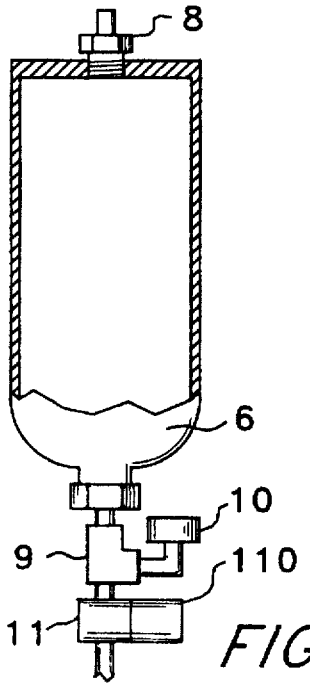
FIG. 14 is the view of FIG. 11 showing the vessel empty after discharging the oil by the internal air pressure.

Referring next to FIG. 8 the user may have an optional switch $S_2$ installed on his dashboard to manually power the solenoid 110. This arrangement is useful when using the system for engine wear calibration. The theory for engine wear calibration rests on the fact that main bearings and other critical internal parts will wear gradually, thus offering less and less resistance to the pressure in vessel 6. Therefore, timing the time for completely emptying vessel 6 of a known quantity of oil 120 at a known ambient temperature, engine temperature, and type of oil, will result in a measurement of engine wear. The user can fill the vessel as shown FIGS. 11, 12. Air pressure is applied to the vessel 6 as shown in FIG. 13 using air hose 130. He can then turn switch $S_2$ "on" and time the emptying of vessel 6 as shown in FIG. 14. The pressure gauge 10 will read zero when the vessel 6 is empty.

Figure 15:
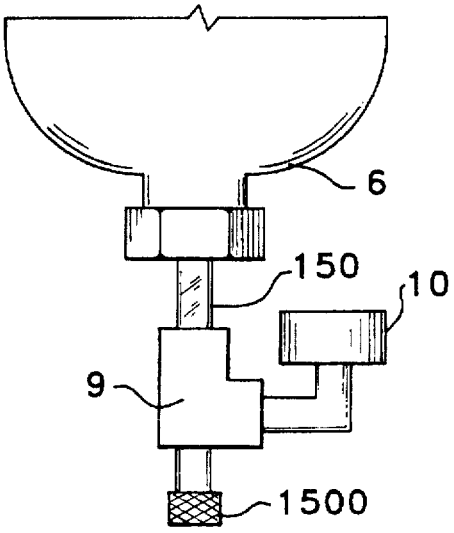
FIG. 15 is a close-up of the transparent oil line segment used to determine when the vessel has been emptied in an engine calibration test.

Alternatively, a transparent sightglass 150 shown in FIG. 15 may be installed to view the empty vessel 6. FIG. 13 also shows air space 1300 which is necessary in all of the embodiments and processes described herein because only the air, not the oil, is compressible.

An alternate embodiment shown in FIG. 15 is to use a portable version of the vessel 6 and pressure gauge 10 and sight glass 150 as a mechanic's engine lube system analyzer. The connector 1500 would removably connect into the engine's oil system in a known manner.

Another method for using the invention shown in FIG. 15 as a lube system analyzer yielding the same comparative result uses a timed drop of a chosen pressure drop, nominally 40 psi to 20 psi. Pressure gauge 10 and a stop watch are all that are needed for this measurement. These calibrations can be used to alert a trucker that it is time to tear down the engine before a breakdown occurs. As an example, a new engine may have a normal leakdown of 45 seconds with 60 psi regulated, 10 w 40 oil, a warm engine at the time you change the oil. After 80,000 miles, the time drops to 37–40 seconds at 60 psi. Then suddenly at the 83,000 mile oil change, the time drops to 25 seconds. Then the mechanic knows that further trouble shooting is necessary. This process can avoid extreme engine damage. Again, for this process to be viable reasonably well maintenance records must be kept. Many commercial types of engines are only shut off at the time of required maintenance as in oil change or when they do break down. This is because the test described above is very simple and non-time consuming. This process could easily be done at every oil change or when deemed necessary. It could also eliminate the need for regular testing of oil samples which is $50–$150 each time the oil is changed to test for metal accumulation in the sample oil. The mechanic may choose to only send the sample oil in when further trouble shooting steps are deemed to be necessary after a bad oil leakdown test is rendered. Also a mechanic can check a car for a potential used car buyer. Up until this device and process, there has been no economical way to know if you have an engine with 100,000 miles of bearing wear in 50,000 miles on the odometer or 50,000 miles on the bearings with 100,000 miles on the odometer. This process is similar to a compression test that can test the piston rings and valves for wear.

Figure 9:
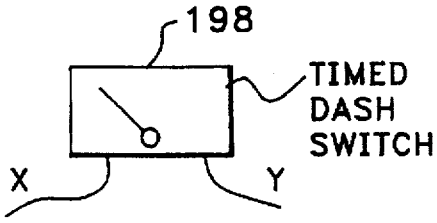
FIG. 9 is a schematic of a manual control switch used to control an optional heater on the output line of the vessel.
Figure 10:
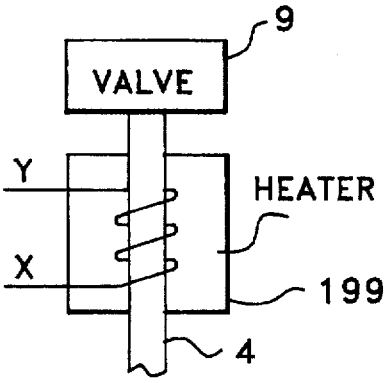
FIG. 10 is a schematic of the heater on the output line.

Referring next to FIGS. 9, 10 an optional oil heater 199 is installed on oil line 4. The user can activate a timer switch 198 on the dashboard to power the heater for a preset time. An alternative bottle blanket heater (not shown) could be installed around the vessel 6.

Examples of this oil preheat option are noted here.

A. Using a special bottle blanket to preheat the oil while it is in the cylinder to approximately 175° to 210°. A thermal cutoff switch limits temperature. The results are:

1) Reduces battery current by 20–30% during cold weather start-up, greatly reducing starter and engine wear especially on high-compression diesel engines. It also takes less time to start.

2) By the preheating of the bottle, cylinder pressure also increases, thus forcing the pre-warmed oil through the engine at a faster rate.

B. Inline coil (FIG. 10) preheats the oil as it exits the valve assembly. It takes less power than the bottle blanket style and is faster, but it doesn't increase the bottle/cylinder pressure and was found to decrease cold weather starting/cranking current 15–20%, thus allowing the engine to turn over faster with less wear and tear on associated components.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An engine pre-oiler comprising:

a pressure vessel having an oil line to an engine oil system having oil; said pressure vessel further comprising a filler plug removably engaged in said pressure vessel:

said filler plug further comprising an air pressure inlet;

a control valve mounted in the oil line;

said control valve consisting of a pressure-balancing chamber and a plug means slidably engaged in the pressure-balancing chamber functioning to separate the pressure balancing chamber into an engine pressure compartment $p_2$ having an engine connection and a vessel pressure compartment ($p_1$) having a pressure vessel connection;

said control valve further consisting of a first port from the engine connection to the pressure-balancing chamber, wherein said plug in a closed position closes the first port, and further consisting of a second port from the pressure vessel to the pressure-balancing chamber, wherein said second port is continuously open and enables the vessel pressure to urge the plug means to the closed position after a spring means urges the plug means to the closed position; and a control valve actuator means functioning to urge the plug means to an open position from a signal means functioning to open the control valve, thereby enabling pressurized oil to flow from the pressure vessel to the engine oil system.

2. The pre-oiler of claim 1, wherein the first port further comprises a location in a center of the chamber aligned with a center of the plug means.

3. The pre-oiler of claim 1, wherein the control valve actuator means further comprises a solenoid.

4. The pre-oiler of claim 3, wherein the signal means further comprises a voltage from an ignition switch.

5. The pre-oiler of claim 3, wherein the signal means further comprises a voltage from a manual switch.

6. The pre-oiler of claim 4, wherein the signal means further comprises a pulse stretcher assembly.

7. The pre-oiler of claim 3 further comprising a heater means functioning to preheat the oil in the pressure vessel.

8. The pre-oiler of claim 1, wherein the pressure vessel further comprises a pressure gauge.

9. The pre-oiler of claim 8, wherein the oil line further comprises a sightglass.

10. The pre-oiler of claim 3, wherein the solenoid further comprises a constant control voltage to remain open during engine operation, thereby enabling oil to flow from the vessel to the engine during an engine oil pressure drop.

11. The pre-oiler of claim 7, wherein the heater means further comprises a blanket heater mounted around the pressure vessel.

12. A pre-oiler comprising:

a pressure vessel having an oil line connected to an engine oil system having oil;

said pressure vessel further comprising a filler plug and an air pressure inlet;

a control valve mounted in the oil line;

said control valve having a solenoid opening means functioning to open a plug in a pressure-balancing chamber;

said pressure balancing chamber consisting of a fluid connection to the pressure vessel and a vessel pressure compartment ($p_1$) and a fluid connection to the engine and an engine pressure compartment ($p_2$), whereby when $p_1=p_2$ a spring means functions to move the plug to a closed position, and whereby an engine operating oil pressure automatically moves the plug to an open position to fill the pressure vessel with oil, and whereby a switch means functions to activate the solenoid opening means, thereby enabling the oil in the pressure vessel to enter the engine oil system.

13. The pre-oiler of claim 12 further comprising a heating means functioning to preheat the engine oil.

14. The pre-oiler of claim 12, wherein the switch means further comprises an ignition switch voltage and a pulse stretcher assembly.

15. The pre-oiler of claim 14, wherein the switch means further comprises a manual switch voltage.

16. An engine pre-oiler system in combination with an internal combustion engine including conduit means fluidly interconnecting the lubrication system of the internal combustion engine and the accumulator lubrication system for admitting lubricant prior to start-up of said engine comprising:

a cylindrical container defining a reservoir for accumulating the lubricant under pressure being mounted in close proximity to the exterior of said engine and oriented in a generally vertical position relative to the earth's horizon;

a fitting mounted on the bottom of said container;

a cylindrically shaped valve housing formed from a non-magnetic material having a valve seat for admitting lubricant into said reservoir supported to said fitting;

a globe valve formed from a magnetic material slidably mounted in a bore formed in said valve housing having an end cooperating with said valve seat, first resilient means at one end remote from said end of said globe valve urging said globe valve toward said valve seat to bias it in the closed position;

solenoid means mounted at the end of said valve housing remote from said end and surrounding a portion of said globe valve;

means including an actuation switch for energizing said solenoid to retract said globe valve to flow lubricant from said reservoir through said valve seat, through said bore, through a passage formed on the side wall of said valve housing and through said conduit means;

fluid return means including said conduit means for leading lubricant from said engine back to said reservoir, through said passage, through a restrictive passage formed between the outer surface of said globe valve and said valve seat, to said reservoir, whereby the resilient means and the pressure of the fluid in said reservoir urges said globe valve closed when the pressure in said reservoir reaches a value equal to the maximum value produced by the lubrication system of said engine; and said cylindrical container further comprising a filler plug removably engaged in said cylindrical container and an air pressure inlet.

17. A system as claimed in claim 16, wherein said cylindrical container further comprises a pressure gauge.

18. A system as claimed in claim 16, wherein said valve housing is closed on one end defining with said bore a spring retainer for supporting said first resilient means.

19. A system as claimed in claim 18, wherein said first resilient means is a coil spring having a first end bearing against said spring retainer and an opposite second end bearing against the end of said globe valve remote from said first end of said coil spring.

* * * * *